US006113756A

United States Patent [19]

Juric et al.

[11] Patent Number: 6,113,756

[45] Date of Patent: Sep. 5, 2000

[54] CATHODE CONSTRUCTION

[75] Inventors: Drago Dragutin Juric, Bulleen; Raymond Walter Shaw, New Gisborne, both of Australia; Boris Eu Paton, Kyiv, Ukraine; Victor J. Lakomsky, Zaporizhia, Ukraine; Alexander Ja Taran, Zaporizhia, Ukraine; Michael A. Fridman, Zaporizhia, Ukraine

[73] Assignees: Comalco Aluminium Limited, Melbourne, Australia; Plasma Technology Scientific and Engineering Centre of E O Paton Electric Welding Institute of Ukraine, Zaporizhie, Ukraine

[21] Appl. No.: 09/147,361

[22] PCT Filed: Jun. 18, 1997

[86] PCT No.: PCT/AU97/00388

§ 371 Date: Dec. 8, 1998

§ 102(e) Date: Dec. 8, 1998

[87] PCT Pub. No.: WO97/48838

PCT Pub. Date: Dec. 24, 1997

[30] Foreign Application Priority Data

Jun. 18, 1996 [AU] Australia ..... 00534

[51] Int. Cl.[7] ..... B01D 59/40

[52] U.S. Cl. ..... 204/243.1; 204/247.3; 204/247.7; 204/294

[58] Field of Search ..... 205/372, 374, 205/380, 375; 204/243.1, 247.3, 247.7, 294

[56] References Cited

U.S. PATENT DOCUMENTS

| | | | |
|---|---|---|---|
| 2,824,057 | 8/1950 | Thayer | 205/372 |
| 3,390,071 | 10/1964 | McMinn et al. | 205/374 |
| 3,775,281 | 11/1973 | Schmidt-Hatting | 204/244 |
| 4,316,788 | 2/1982 | Sele | 204/247.1 |
| 4,462,885 | 7/1984 | Kato et al. | 204/247.1 |
| 4,608,134 | 8/1986 | Brown | 204/247.3 |
| 5,203,971 | 4/1993 | de Nora et al. | 205/374 |

FOREIGN PATENT DOCUMENTS 81 01299 5/1981 WIPO .

OTHER PUBLICATIONS

"Welded Multiampere Contacts of Carbon Materials with Metals in Aluminum Cells", Lakomsky, Aluminium, 70, Jan. 1994, pp. 105–109.

"Oxide Cathode for Electric Arcs", Lakomsky, High Temp. Chem Processes 2 (1993), pp. 83–94 No Month Available.

*Primary Examiner*—Bruce F. Bell

*Attorney, Agent, or Firm*—Dennison,Meserole, Scheiner & Wakeman

[57] ABSTRACT

An electrolytic reduction cell for production of a metal includes an outer steel shell, a layer of insulating material adjacent the outer steel shell and a carbonaceous layer overlaying the insulating material and protecting the insulating material from an electrolytic bath to be contained in the cell. The carbonaceous layer includes at least one carbonaceous cathode block having an upper surface and a lower surface, with a plurality of electrical contact plugs being mounted in electrical contact with the lower surface of the cathode block. A collector plate is in electrical contact with the electrical contact plugs. The electrical contact plugs are distributed over the lower surface of the cathode block such that in operation of the cell, a substantially isopotential surface is achieved at the top surface of the cathode block.

7 Claims, 5 Drawing Sheets

CATHODE CONSTRUCTION

BACKGROUND OF THE INVENTION

The present invention relates to an electrolytic reduction cell for the production of a metal, such as aluminium. The invention particularly relates to a cathode construction used in such cells.

Aluminium metal is generally produced by the Hall-Heroult process in which electrical current is passed through an electrolytic bath comprising alumina dissolved in molten cryolite to cause the electrodeposition of molten aluminium. Electrolytic reduction cells comprise an outer steel shell that is lined with a layer of insulating material, such as refractory bricks. Carbonaceous blocks are placed on top of the insulating layer and these carbonaceous blocks form the cathode of the cell. The cathode must last for the expected operating life of the cell, which is typically 1000 to 2000 days. A number of consumable anodes are located a short distance above the cathode. In use, the electrolytic bath is located between the cathode and the anodes and the passage of electrical current through the cell causes molten aluminium to form at the cathode. In conventional cells, the molten aluminium collects as a pool on top of the cathode and in operation the pool of molten aluminium acts as the top of the cathode. Aluminium is periodically drained from the cell, typically on a daily basis.

Electrolytic reduction cells are arranged in potlines in which a large number of cells are connected in series. Electrical current enters a cell through the anodes, passes through the electrolytic bath and pool of molten metal and into the cathode. The current in the cathode is collected and passes to an external current carrier and then along to the next cell.

In conventional aluminium reduction cell technology, embedded collector bars are used to collect electrical current from the carbonaceous cathode and conduct it to the external ring bus. The embedding of collector bars, which is performed with the use of cast iron or carbonaceous glue, imposes a number of limitations which adversely affect service life, cost and performance of aluminium reduction cells.

Accommodation of collector bars within the cathode carbon requires a machined groove to be formed in the block and thus increases the cost of cathode blocks and at the same time, the presence of a groove reduces the potential cell life (available erodable lining), in some cases by about 40%. Furthermore, the cathode current density distribution along the length of the cathode blocks is uneven with the outermost portions of the cathode blocks drawing current at up to three to four times higher density compared to the inner portions of the block.

In embedded collector bar technology, the bar is either cast or glued into a recess on the underside of the cathode block. Under normal operating conditions the electron transfer from the collector bar to the carbon occurs through active spots (a-spots) which are concentrated along the sides of the collector bar and nearest to the block end. The top portion of the collector bar normally does not participate in electron transfer as its own weight and a lack of high-temperature strength causes it to sag. The concentration of a-spots along the sides of the collector bar slots increases the average current path length in the cathode carbon and thus increases cathode voltage loss.

Most of the current transfer from collector bars to carbon occurs near the block end and this leads to uneven current distribution on the surface of the cathode. It is highest nearest to the outer edge of the anode shadow or ledge toe. The uneven cathode current density has a dual effect on cell operation: on the one hand it increases the rate of dissolution of carbon by increasing the chemical activity of sodium (this drives the aluminium carbide forming reaction) in the affected region, and on the other, it increases the rate of transport of dissolved aluminium carbide by inducing circulation of metal and catholyte. This increased circulation can result either from the increased metal pad heave due to interaction in the metal pad of horizontal currents with the vertical magnetic fields or from the Maragonni effect (i.e. circulation induced by uneven interfacial tension between catholyte and aluminium due to uneven cathode current density distribution at the interface). The rate of erosion of carbon is directly related to the rate of circulation of metal and catholyte.

As neither the horizontal currents in the metal pad, nor the interacting magnetic fields are even, balanced, or static, their coupling can lead to hydrodynamic instability of the metal-bath interface. The circulation of the metal, the deformation of its surface and the instability of the metal-bath interface, are the three most significant limitations of the current technology cells which affect their potlife (cathode and sidewall erosion) and operating efficiency.

In conventional current feeding technology it is difficult to build a reduction cell which can have a completely uniform cathode current density distribution throughout the cell. The best which can be achieved is to reduce the variation of current density distribution by constructing relatively narrow cells, using relatively deep, high resistivity, anthracitic cathode blocks and using large steel collector bars. The problem of metal heave and metal pad stability (product of field current interaction) was then addressed through the modification of bus bars to control the vertical magnetic field. Modem magnetically compensated cells are a good example of this type of engineering within the limitations of the system.

This problem of cathode current density distribution and the presence of horizontal currents in the metal pad has restricted the cell design to construction of relatively narrow, but long reduction cells. Such furnace designs are at a disadvantage as they have a high external surface to production volume ratio, hence have a high heat loss. In conventional cell construction methods, these limitations resulting from embedded collector bar technology have been accepted as inherent to the nature of the aluminium reduction cell cathode and its negative impact was minimised by focussing on improving the magnetic field aspect of the current/field interaction. Modem reduction cells are designed with magnetic compensation in order to improve the hydrodynamic stability of the cells. However, this requires relatively expensive external bus bars.

In a paper published in Aluminium, 70, Jahrgang, 1994, pp 105–109, Lakomsky, one of the present inventors, described sources of electrical resistance in an electrolytic reduction cell. In particular, in cells there is invariably electrical contacts at interfaces between steel based conductors and carbonaceous materials. Such contacts occur, for example, at the collector bar/cathode carbon interface. Collector bars are typically mounted into a slot formed in the bottom of the cathode carbon block and molten cast iron is poured around the collector bar. Although the cast iron wets the steel collector bar to ensure very good contact therebetween, the molten cast iron does not wet the carbonaceous material of the cathode. Accordingly, the cast iron and cathode carbon do not form a continuous electrical joint. The two solid surfaces do not make contact over the entire surface area but rather at discreet points, called a-spots. Passage of electrical current through the a-spots depends on overcoming the contact resistance in each of the contact materials near the a-spots. The greater the number of a-spots, the lower the contact resistance.

This paper further describes a method of improving the contact of carbon material with metal such that contact resistance is reduced. The method involves welding the contacting parts together so that permanent joints are established that block the access of air or other oxidising agent to the interface and hence prevent oxidation at the interface. The welded joint more importantly increases the actual contact area between the metal and the carbonaceous material to thereby reduce the contact resistance.

Such welded joints were embodied in the Lakomsky paper by "electrical contact plugs" welded into a carbonaceous material. The diametral section of such an electrical contact plug is shown in FIG. 5 of Lakomsky. The plug diameter and height were chosen to provide a tight contact of the plug to the carbon material over the entire contact boundary, whilst ensuring that no cracking resulted from metal shrinkage during solidification in the plug, no cracking in the carbon layers close to the plug due to thermal stresses and no failures in the fusion line due to the difference in the thermal expansion coefficients of the dissimilar material. It was found that plugs of 30 mm diameter and depth were the most useful.

The electrical contact plugs were mounted in the slot formed in the cathode carbonaceous material that accepts the collector bar. In particular, the plugs were welded into the block body on the horizontal slot surface. The cathode carbon with electrical contact plugs mounted thereto were joined to steel collector bars by a standard method using molten cast iron. Apart from using electrical contact plugs, the assembled cathode blocks did not differ in any way from standard cathode blocks.

In mounting the steel collector bar in the slot in the cathode block, the molten cast iron wets both the surface of the collector bar and the open surface of each electrical contact plug. This forms "bridges" of lower electrical resistance between the carbon block and the collector bar. Operation of cells in a plant environment incorporating a cathode constructed as described above resulted in a cathode voltage drop of 40–50 mV, when compared to plug-free cells. In the plant at which the trials were conducted, this resulted in a saving of 130–170 kWh per tonne of metal produced.

The present invention provides an improved cathode construction for an electrolytic smelting cell.

SUMMARY OF THE INVENTION

In one aspect, the present invention provides a cathode construction for an electrolytic reduction cell for the production of a metal, the cathode construction including at least one carbonaceous block, a plurality of electrical contact plugs mounted in electrical contact with a lower part of the cathode and at least one collector plate in electrical contact with the electrical contact plugs.

In another aspect, the present invention provides an electrolytic reduction cell for the production of a metal comprising an outer steel shell, a layer of insulating material adjacent the outer steel shell, a carbonaceous layer overlying the insulating material and protecting said insulating material from an electrolytic bath in the cell, the carbonaceous layer including at least one carbonaceous cathode block having a plurality of electrical contact plugs mounted in electrical contact to a lower surface of the at least one carbonaceous cathode block and at least one collector plate in electrical contact with the electrical contact plugs.

The collector plate may be positioned underneath the at least one carbonaceous cathode block. In this way, the collector plate not only provides good electrical contact with the electrical contact plugs but also provides a physical barrier to infiltration of the electrolytic bath into the insulating lining underlying the collector plate.

In a preferred embodiment, the plurality of electrical contact plugs are positioned or distributed on the lower surface of the cathode in such a way that an isopotential surface is achieved at the top of the cathode blocks. This isopotential surface may be achieved irrespective of the current path length. In particular, the required number of electrical contact plugs can be spatially positioned in such a way so as to reduce unwanted current flows and to produce a minimum electrical field resistance between the plugs. With this approach the resistance of the assembly can be minimised and the current distribution within the assembly controlled. Conventional embedded collector bar technology does not have the ability to control the size and distribution of active spots and hence cannot achieve a uniform cathode current density. The electrical plugs distribute current much further into the cathodes than conventional collector bars and this provides much greater opportunity to control and design electrical flows and fields in the cell.

Alternatively, rather than positioning or distributing the plurality of electrical contact plugs on the lower surface of the cathode block in such a way as to achieve an isopotential surface at the top of the cathode blocks, the electrical contact plugs may be positioned or distributed such that a desired electrical field is established at the top surface of the cathode (and extends into the metal pad during operation of the cell). For example, it may be desired to achieve an electrical field that counteracts at least to a degree external electrical fields that impinge on the cell. It may also be desirable to establish an electrical field that, in operation of the cell, results in controlled movement or flow of the metal in the metal pad. For example, the controlled movement of the metal in the metal pad may comprise a slow circulation of metal (which assists in cell operation) whilst avoiding humping and sloshing of the metal and reducing or minimising vertical movement of the metal in the metal pad.

The electrical contact plugs are preferably mounted to the cathode carbon by means of a welding technique, such as a plasma arc welding process. The so-called Dugatron arc welding process, as is described in Lakomsky, Journal of High Temp Chem Processes, 2 (1993) pp 83–94, is especially suitable. The entire contents of that paper are herein incorporated by cross-reference.

In another embodiment, the electrical contact plugs are formed by filling appropriately sized holes in the carbon block, filling the holes with metal powders, mixed oxide powders or mixtures thereof, and heating to form the electrical contact plug.

The at least one collector plate is in electrical contact with the electrical contact plugs. Although electrical contact may be achieved by bringing the collector plate(s) into contact with the electrical contact plugs and effectively allowing the weight of the cell above the collector plate(s) to maintain electrical contact, it is preferred to attach the collector plate(s) to the electrical contact plugs, for example, by direct welding or by immersion welding.

The at least one collector plate is preferably positioned between the insulating material and the cathode carbon. The at least one collector plate may run the full width or the partial width of the cathode carbon. A single collector plate may be used, or a plurality of smaller collector plates may be used. Each plate may be of uniform thickness or the thickness of individual plates may vary. This could assist in achieving rough equalisation of resistances underneath the cathode. The collector plate(s) may also be clad or coated with a low resistance material, such as copper, to reduce voltage losses without increasing heat losses from the cell.

The use of one or more collector plates also allows the possibility of using carbon blocks having flat bottoms as the cathode. This reduces the cost of constructing the cell because grooves for collector bars do not have to be machined into the carbon blocks. Moreover, the life of the cathode should also be increased in the absence of a groove for a collector bar.

A preferred embodiment of the present invention will now be described.

Without wishing to be bound by theory, the present invention was developed on the premise that the current transfer across any solid interfaces occurs via active spots (a-spots). Further, it is postulated that the current flowing through one spot interacts with the current flowing through neighbouring spots to produce mutual electrical field effects. This interaction increases the resistance of the total assembly. Therefore to achieve lowest possible resistance of an assembly, one has to control the a-spot activity on the contact surface and ensure that the spatial distribution of a-spots is arranged to minimise their mutual electrical field interactions.

The a-spot activity at an interface can be controlled by the use of Electrical Contact Plugs (ECP) which are welded to the carbon by means of the Dugatron Plasma Arc welding process. The size and shape of the ECP's, the weld alloy composition, service temperature and amperage loading per plug can be designed to maximise the contact area of the carbon/metal interfaces and to reduce the thermoelectric effects and thus produce a low resistance in any individual ECP. The required number of ECP's can then be spatially positioned in such a way so as to feed the current where it is needed to thereby reduce unwanted current flows and to produce an optimum electric interference between the plugs. With this approach the resistance of the assembly can be optimised and the current distribution within the assembly controlled.

In designing the shape of the ECP's, the following underlying assumptions were used:

the weld metal has negligible resistance, most of the ECP resistance is due to the resistance of the weld/carbon interface due to carbide formation, and the carbon material contributes most of the current constriction and electric field interaction resistance.

On this basis the resistance of a single plug can be defined as follows:

$$R_s = \frac{\rho_{cm}\left[\ln\left(1+\sqrt{1-x^2}\right)-\ln\left(1-\sqrt{1-x^2}\right)\right]}{4\pi l\sqrt{1-x^2}} \quad (1)$$

where,

ρcm is specific resistivity of carbon material, ($\mu\Omega$m)

x is the r/l ratio l is length of the plug(m)

r is radius of the plug(m)

A graphical analysis of $R_s$=f(x) shows that x=1 is the optimum value, corresponding to a hemispheric shape of the plug. In this case quite a low $R_s$ is achieved with the least contact alloy consumption.

With further increases in the value of x, resistance goes down slightly, but the alloy consumption for plug production is increased proportionally with $r^2 1$; hence the efficiency of the alloy consumption is reduced.

Welding of carbon to metal leads to generation of tensile stresses at the interface between the metal plug and the carbon surface. This occurs as a result of higher shrinkage of a weld metal on cooling following solidification compared to carbon. The tensile stresses generated in the plug body are related to the properties of the electric contact alloy and the plug shrinkage.

$$\varsigma = E\Delta\frac{d}{d} \quad (2)$$

where,

E is Youngs modulus of the weld metal (MPa);

Δd is the absolute shrinkage of the plug of d diameter. If the plug metal/carbon material adhesion is rather high, the stresses generated in the metal can cause microcracking in the carbon block around the plug as the tensile strength of the carbon block material is much lower than that of the plug material. To avoid this it is preferred to use hypoeutectic or hypereutectic alloys as materials for the plugs since they have lower shrinkage.

The size of each ECP is selected on the basis of the difference in thermal expansion of the carbon material and weld metal using the following formula:

$$\Delta d = dT_s\Delta\alpha \quad (3)$$

where, $T_S$ is solidus temperature of the alloy (K); and

Δα is different in thermal expansion coefficients between metal and carbon materials. ($K^{-1}$).

Finite element modelling work suggests that 15–30 mm diameter by 20–40 mm deep plug holes are best for welding metal to carbon. Such plugs have an optimum current rating of 400–800 amps. The strategy used to minimise cracking in carbon involves the use of small EC plugs and the use of welding alloys having low Ts, low α and low E.

As an electric contact alloy for the plug a metallic alloy which provides for wetting and impregnation of the cathode block material is used. The wetting angle of the carbon material at 1900–2000K should not be over 30°. Solidus temperature of the alloy should be 250–300° K. higher than the operating temperature of ECP's.

The weld metal is based on iron. To achieve the proper wetting angle two or three carbide forming elements from the following: B, Si, Ti, V, Cr, Mn, Zr, Nb, Mo, Ta, W, and Rh are used. Such elements as Ni and/or Co may also be included into the alloy composition for their effect on the thermal expansion coefficient of the alloy.

A wide two-phase region of the alloy can be provided by adding copper, which is indifferent to carbide forming elements.

Apart from wetting, alloy selection is influenced by the electrical conductivity of the carbide formed. Ideally the carbide and the alloy should be stable with respect to the permeation of cryolite bath and sodium metal. Plant trials have shown that silicon is the most suitable carbide forming alloying element for ECP's used in the cathodes of aluminium reduction cells. The main advantage of silicon was its ability to form a dense but thin layer of silicon carbide at the metal/carbon interface which then protects the weld metal from bath sodium attack.

Two procedures of attachment of ECP's welded into the cathode block to the collector plate have been developed:

welding of each plug to the collector plate by electroriveting with a standard coated electrode;

welding by immersion of a steel or copper rod into each plug until it is solidified. The frozen rod is later welded to the collector plate using a standard coated electrode.

Alternatively, heating of metal powders, mixed oxide powders or mixtures thereof may be used to form the electrical contact plugs.

The first procedure is easier to perform than the second if the plug material is highly weldable. However, carbide forming elements and the carbon, which is dissolved in the plug material during welding into the cathode block, sharply reduces the plug metal weldability.

Riveting technology (i.e. standard welding) provides a rigid weld joint between the cathode block and the collector plate. Allowing for the difference in thermal expansion coefficient between the collector plate (made of low-carbon steel) and the cathode block (made of carbon material) the maximum distance between ECP's is limited to about 200 mm.

The two requirements for successful attachment of collector plates to carbon, namely, to use alloys which have a high carbide forming ability on the one hand and have a good electrical conductivity, high plasticity at elevated temperatures and good weldability on the other, are not readily achieved in practice. In order to overcome this difficulty, an alternative welding process utilising binary alloys is used to mount the ECP's and subsequently connect the ECP's to the collector plate. In binary welding technology two alloys are used. The primary wetting alloy is based on a lighter low melting metal such as aluminium and contains a higher concentration of carbide forming elements, such as silicon, titanium, zirconium, chromium, etc. and the second filler alloy is based on heavier metal such as iron, nickel or copper and contains little or no carbide forming elements. The purpose of the primary alloy is to form a metal carbide reaction layer on the surface of the carbon which can be wetted by the secondary filling alloy. The welding process involves two stages, wetting and filling. During the wetting stage the carbon surface is heat treated with a plasma arc until the primary alloy wets and spreads over the electrical contact surface. Subsequently, the filling alloy is quickly melted into the recess and being heavier, displaces most of the wetting alloy which is then scraped off the surface of the carbon, leaving behind an electrical contact plug consisting of a tightly adhering and electrically conducting metal carbide interface layer on the carbon surface and a filler alloy which wets this interface layer. This filling alloy is then conventionally welded to a metallic conductor.

The second procedure is performed with one and the same alloy composition. A steel or copper rod is frozen into the contact alloy of each plug till it is fully solidified. In setting up the reduction cell, when the cell bottom is preheated to its operating temperature, the rod sets off the difference in thermal expansion between the carbon block and the collector plate. In this case the rod while bending prevents the ECP/collector plate weld joint from failure. This is shown schematically in FIG. 1.

Therefore, in a further aspect, the present invention provides a method for connecting an electrical contact plug to a current collector comprising forming at least an outer shell of an electrical contact plug in a hole in a cathode carbon block, said at least an outer shell being formed of a metal or alloy that wets said carbon, filling said at least an outer shell with a filling metal or alloy and subsequently joining said electrical contact plug to said current collector. Preferably, the filling metal or alloy is joined to the current collector by welding.

In another aspect, the present invention provides a method for connecting an electrical contact plug to a current collector comprising freezing a connecting member into the plug and connecting the connecting member to the current collector. The connecting member may be frozen into the plug by immersing the connecting member into a pool of molten metal in the plug and allowing the pool of molten metal to freeze. The pool of molten metal may be formed by heating a previously-formed plug. Alternatively, the pool of molten metal may remain from the process used to produce the plug.

The minimum number of ECP's required in any current feeding system is determined on the basis of the need to achieve long term stability of performance. From trials, it was established that for stable performance of the ECP the heat generated on the plug surface should not exceed 80 watts (ECP surface heat flux Q−22.5 kW/m$^2$). Therefore, the maximum permissible current draw per ECP depends on its resistance, i.e. the nature of the weld metal used, the carbon type and the quality of the weld, and this is generally between 400 and 800 amperes.

The minimum number of ECP's welded into each carbon block, is related to the electric current value, specified for the cathode block, and the maximum permissible current per ECP.

Often the minimum number of ECP's, $n_{min}$, has to be increased for structural considerations and the desire to reduce the electric resistance of a number of plugs welded into the particular cathode block.

The preferred number of ECP's however is determined on the basis of equation (4) which describes the overall resistance of the system as a function of the number of ECP's.

$$R_{pm} = \frac{1}{n\eta}(R_{ecp} + f\rho_{cm}) \tag{4}$$

where, $R_{pm}$ overall resistance for n plugs (Ω);

n number of ECP's;

η ECP utilisation coefficient, f geometric shape factor of the conductor (m$^{-1}$); and ρcm specific resistivity of carbon material (Ω.m)

The plug utilisation coefficient can be calculated as a function of its radius (r) and distance between plugs (τ) using formula (5):

$$\eta = \left[\left(1 + \frac{(n-1)r}{\sqrt{r^2 + \tau^2}}\right)\right]^{-1} \tag{5}$$

This relationship between the ECP utilisation coefficient and size and spacing of contact points suggests that the plug effectiveness increases with decreasing radius and increasing distance between the contact points.

The relationship between the utilisation coefficient of ECP's and their size and spacing implies that for any conductor geometry there is an optimum number, size and spacing of current feeding points which have the highest cost effectiveness and the best performance. An ideal current feeding arrangement would be to have a large number of small contact points uniformly distributed over the whole of the geometric contact surface. This is not always achievable. The most efficient method however would be to use round conductors with a single large current entry point centrally located. This is not always practicable.

For non "ideal" geometries an optimum ECP distribution can be determined from the relationship between the geometries of the conductor and its feeding system as reflected in the geometric shape factor (f). This is dependent on the length (l) and the cross-sectional dimensions (a,b) of the conductor material and can be determined for a square carbon conductor of 100 to 400 mm having current path length of 200 to 2000 mm from the following equation:

$$f = \left[-0{,}155\left(\frac{l}{ab}\right)^2 + 4{,}022\left(\frac{l}{ab}\right) - 8{,}026\right] \quad (6)$$

For a carbon conductor of a more intricate shape than rectangular parallelepiped or right-angle prism the geometric shape factor is determined by experiment.

For a 550×400 mm cathode block with a 270×145 mm slot, for example, shape factor f is 4.9 $m^{-1}$.

The general rule for the arrangement of ECP's in the cathode block is as follows:

1. The plug axis should coincide in the electric current path in the carbon block.

In this case the overall side and face surfaces of the plug are used for the electric current flow off the plug into the cathode block body.

With the perpendicular position of the plug axis relative to the electric current path only ⅔ of the side plug surface are utilised.

2. The cathode carbon block is to be designed so that the current path length, l, might be as short as possible, and the cross-section of the carbon block, through which the current flows from the collector plate to the liquid aluminium layer (a,b), as large as possible.

DESCRIPTION OF THE PREFERRED EMBODIMENTS

The current in ECP cells is collected by plates which are attached to the underside of the carbon via ECP's. The collector plates run the full or partial width of the blocks and sit underneath the carbon. The basic arrangement of collector plates is shown in FIGS. 2 and 3.

Figure 2:
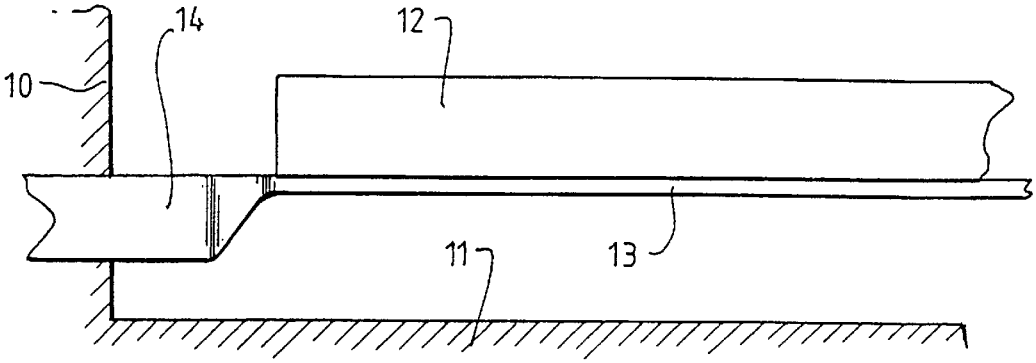
FIG. 2 is an enlarged, side cross-sectional view of a portion of a cell according to the invention.
Figure 3:
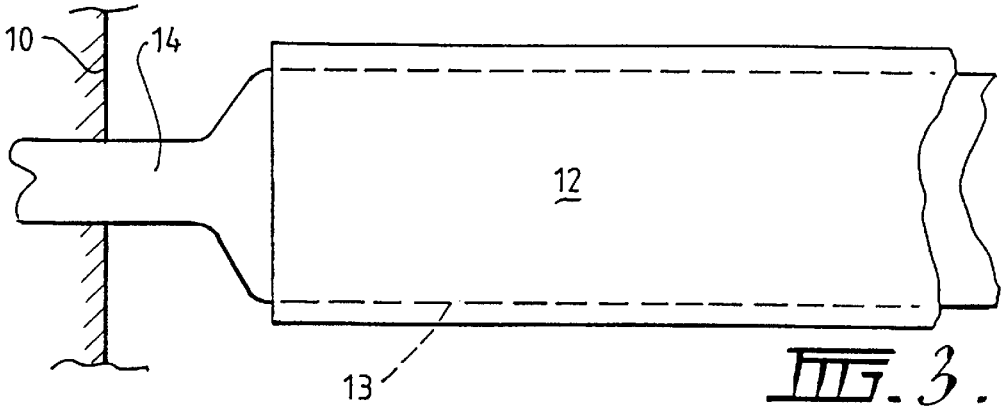
FIG. 3 is a top cross-sectional view of the cell of FIG. 2.

FIG. 2 shows a side, cross sectional view of an electrolysis cell in accordance with the present invention and FIG. 3 is a top, cross sectional view of FIG. 2. The electrolysis cell of FIG. 2 includes a steel shell having a side wall 10 and a bottom 11. Cathode 12 is positioned above collector plate 13. Although omitted for clarity from FIGS. 2 and 3, the electrolysis cell would also include insulation under collector plate 13 and to the side of cathode 12 in order to protect the steel shell from the high temperatures and corrosive bath present during operation of the cell.

Collector plate 13 is joined to or integrally formed with collector bar 14. The collector bar 14 is used to enable conventional steel shells to be used in the present invention. Despite the electrolysis cells utilising collector bars 14, it will be appreciated that collector bars 14 do not extend underneath the cathode and that it is the collector plate 13 that collects current from the cathode.

The plates in this design have a dual role: to conduct the current and to act as a barrier layer to the permeation of cryolite and sodium into the insulation.

The possibility of achieving uniform potential over the entire cathode surface irrespective of the current path length and cathode block geometry is provided in the ECP/collector plate arrangement as follows:

- one or several collector plates may be used in the cell, depending on the cathode block length and the way the plate is attached to ECP's;
- the thicknesses of individual plates could be adjusted with increasing mean current path length to achieve rough equalisation of resistances underneath the cathode;
- the size, the positioning and the density distribution of the ECP's welded to each plate could be further optimised to achieve uniform potential over the entire cathode surface;
- the collector plates could be clad with copper on their underside to reduce the voltage losses without increasing heat losses from the cell.

Figure 4:
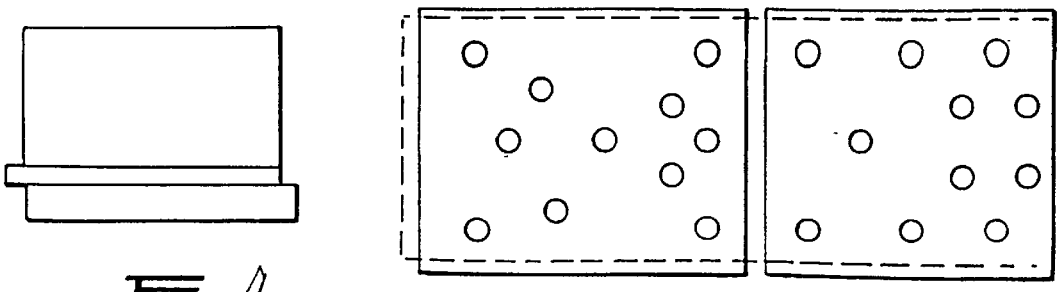
FIG. 4 shows side and plan views of overlapping plates of different thicknesses.

This is conceptually illustrated in FIG. 4 which shows two overlapping plates of different thicknesses and non-uniformly distributed ECP. The two combined, should result in equalisation of resistance irrespective of current path length. The spatial distribution of the ECP's shown in FIG. 3 is arranged such that equipotential surfaces, or close to equipotential surfaces, are achieved on the top of the cathode in use of the cell.

One of the main challenges for implementation of the ECP based current feeding technology is the design of a system for attachment of electrical contact plugs to the collector plates. This system has to have sufficient "give" in it to allow the carbon and collector plates to expand freely and independently. One concept proposed by this invention is based on electro-riveting. In this arrangement the ECP's are installed in a nest arrangement using binary welding technology and finished off flush with the carbon. A mild steel collector plate with pre-drilled 20–25 mm holes is placed over the top and then each hole is stitch welded to the ECP metal. The main disadvantage of this method of attachment is the relative thermal expansion limitation which requires the ECP's to be placed in a next arrangement with the maximum diameter of the nest being about 200 mm. Only one nest of ECP's can be used per plate.

The nest consists of 9 ECP's, 8 of them are arranged uniformly along the circumference of 200 mm diameter, and one in the centre of it. Such a nest can pass a current of 3.6 to 5.6 kA from the collector plate to the cathode block.

Figure 5:
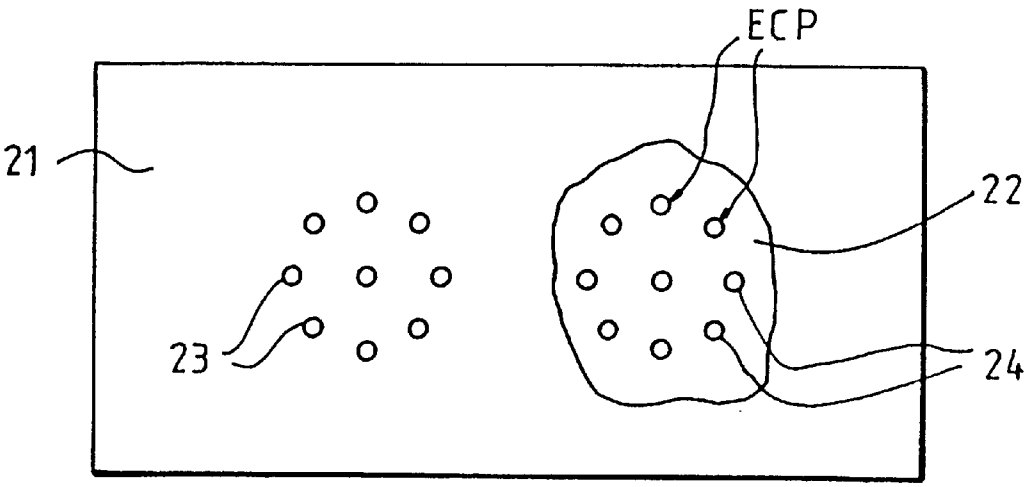
FIG. 5 is a plan view of collector plates that overlap.
Figure 6:
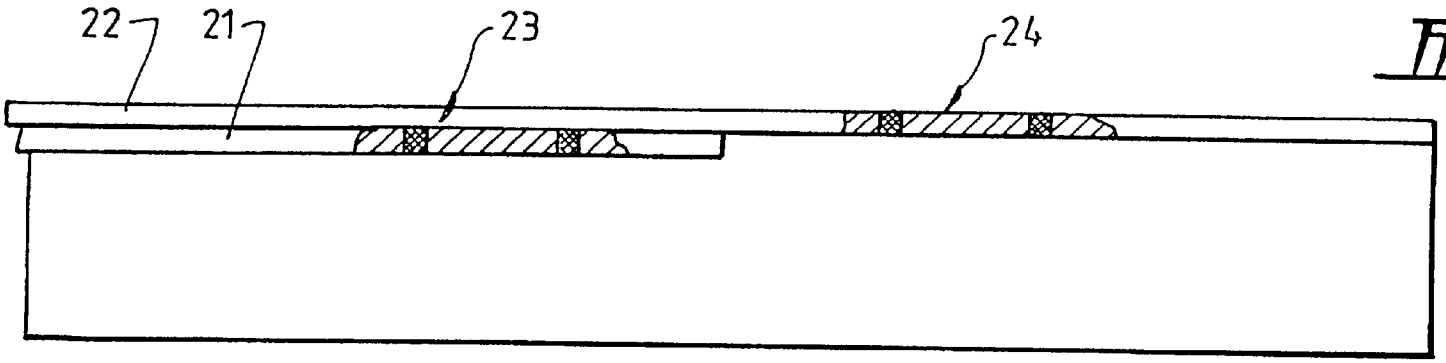
FIG. 6 is a side view of the plates of FIG. 5.

FIGS. 5 and 6 show a nest arrangement of ECPs. FIG. 5 is a plan view of the nest arrangement whilst FIG. 6 is a side view in cross-section of the nest arrangement shown in FIG. 5.

In FIGS. 5 and 6, the arrangement includes collector plates 21, 22 that overlie each other. A first nest 23 of ECP's is mounted with collector plate 21 and a second nest 24 is mounted with collector plate 22. Each nest comprises ECP's, 8 of which are arranged in a circle and the ninth of which is located at the centre of the circle.

Figure 1:
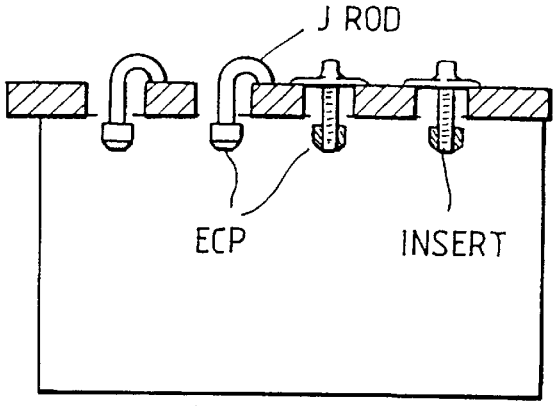
FIG. 1 is a side cross-sectional view of an electrolytic cell.

In an alternative method of this invention 30–40 mm diameter holes are pre-drilled in the collector plate in a desired pattern for ECP positioning. This is followed by positioning of the collector plate over the cathode block and drilling the carbon in a matching pattern. The plate is removed and the ECP's installed by immersion welding. During this process the weld metal contains carbide forming species and once this has achieved adequate penetration and wetting of carbon a small rod is immersion welded into the ECP. The pre-drilled collector plate is then fitted over the protruding rods and these are then welded to the steel plate. The inserts can be made of mild steel or copper. They can have a simple shape or be shaped in a form of a hook to facilitate differential movement between the carbon and steel collector plate. Use of immersion welded rods will allow for differential thermal expansion between the collector plate and carbon by allowing bending of the rods or by bending or straightening of the hooks. This is illustrated in FIG. 1. In this case the distance between the extreme plugs in the cathode block can be up to 800–1000 mm. Basically, there is no limitation for the distance between the extreme plugs of the contact weld assembly.

This system would allow the ECP's to be positioned in any desired pattern and has the advantage of being able to incorporate sufficient elasticity and plasticity into the rods to allow for independent thermal and sodium expansion of carbon relative to the steel plates.

Figure 7:
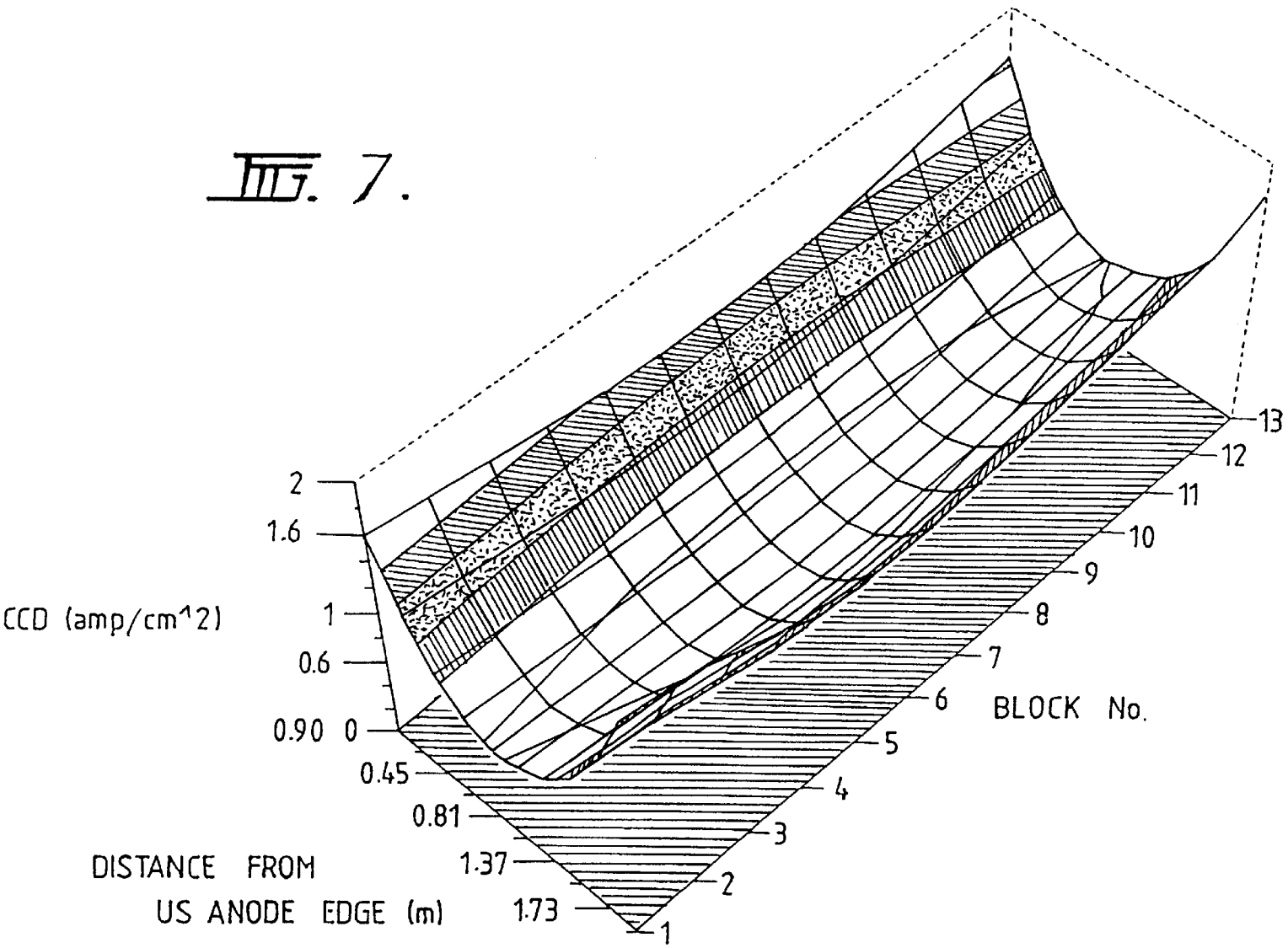
FIG. 7 is a cathode current density diagram for a prior art smelting cell.
Figure 8:
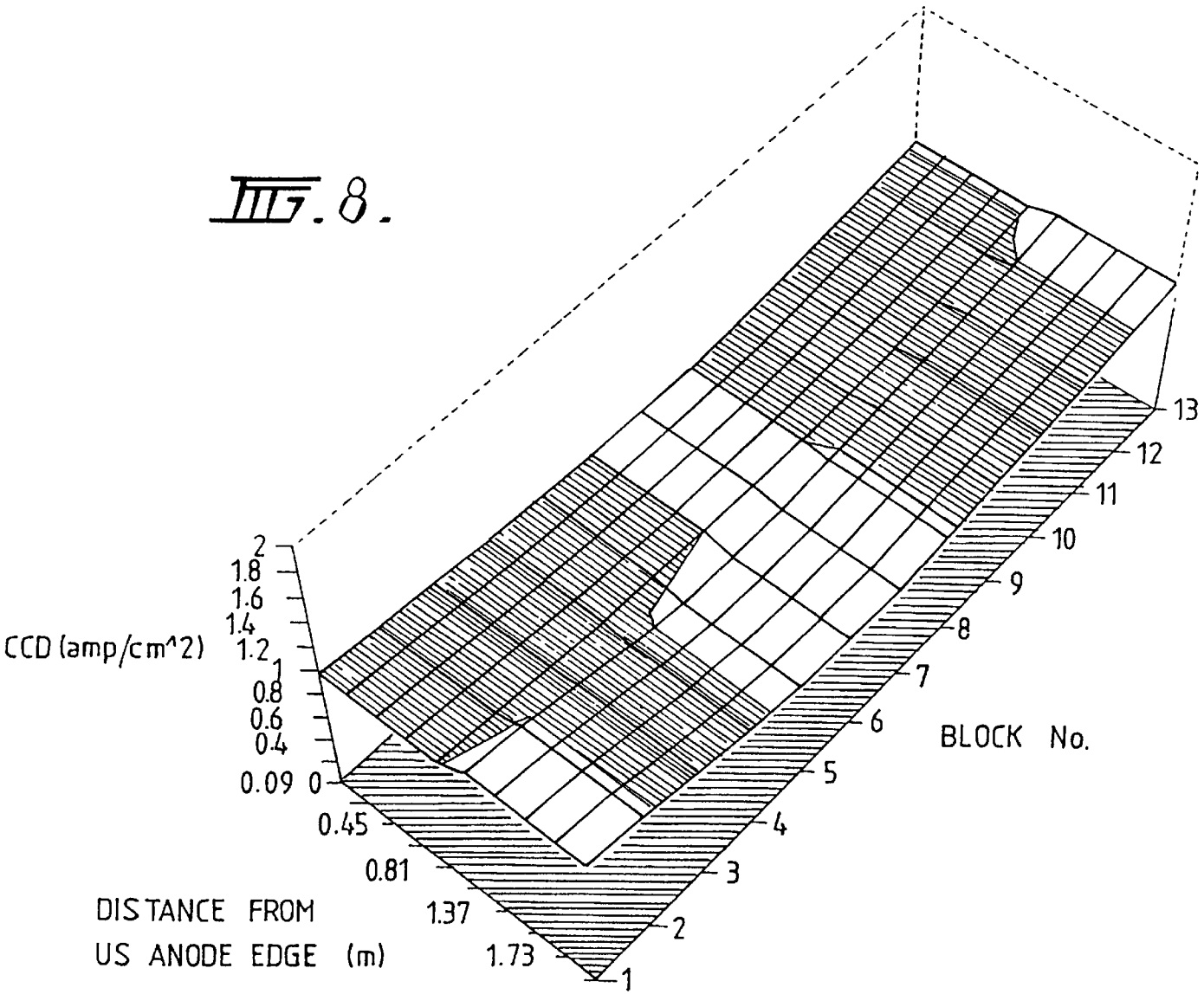
FIG. 8 is a cathode current density diagram for a smelting cell according to the invention.

In order to demonstrate the advantages of the present invention over conventional smelting cells, a series of electrical modelling studies were conducted. FIGS. 7 and 8 show the cathode current density derived from the modelling studies. FIG. 7 shows the cathode current density for a standard smelting cell having a graphite carbon cathode and a conventional collector bar. FIG. 8 shows the cathode current density for a smelting cell having a graphite carbon cathode, a collector plate and electrical contact plugs. As can be seen by comparing FIG. 7 with FIG. 8, the cathode current density of the cell incorporating the present invention is much more uniform than the cathode current density of the conventional cell shown in FIG. 7.

A test cell has also been constructed and operated at the applicant's Bell Bay Smelter in Tasmania, Australia. An end cross-section of the cathode construction is shown in FIG. 9 and an underneath view of the cathode showing the spatial arrangement of the electrical contact plugs is shown in FIG. 10.

For the purposes of the test cell, conventional cathode blocks having a central bottom channel for receiving a conventional collector bar were used. For constructional purposes a collector bar was placed in the central channel. However, the collector bar was cut in half prior to placing in the channel and the ends of the two pieces of the collector bar were separated by a gap of 100 mm. Furthermore, a layer of an electrically insulating material was placed between the collector bar and the cathode block. These steps ensured that the collector bar was not connected to the cathode blocks.

Figure 9:
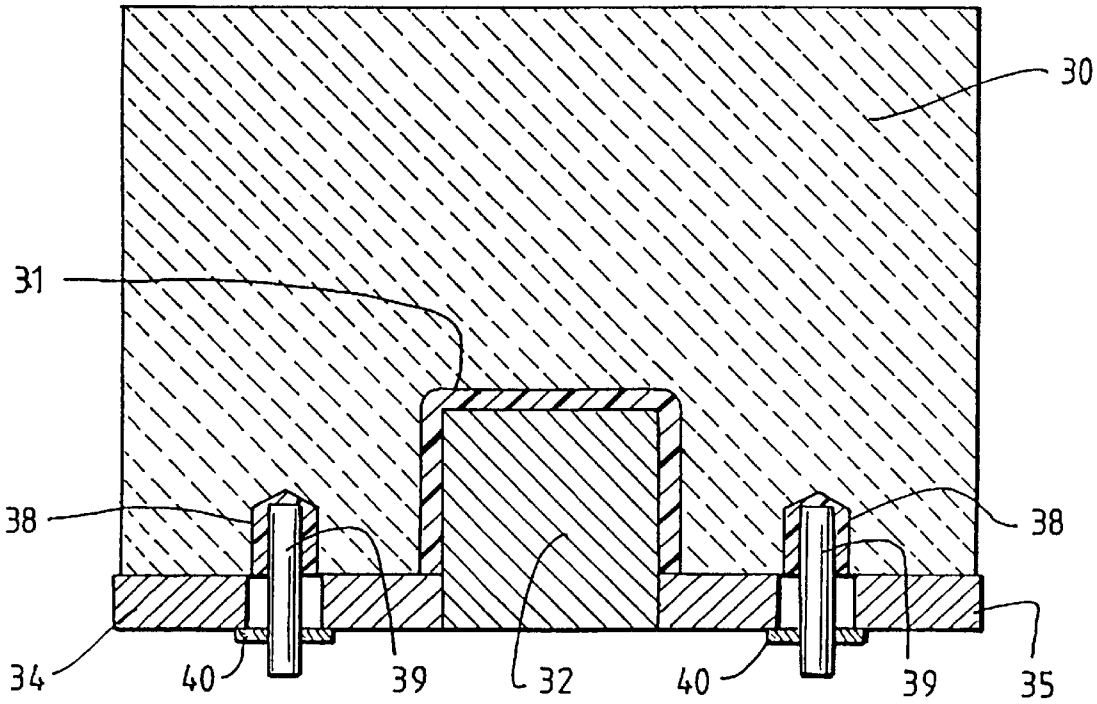
FIG. 9 is an end cross-sectional view of an alternate embodiment of a cell according to the invention.
Figure 10:
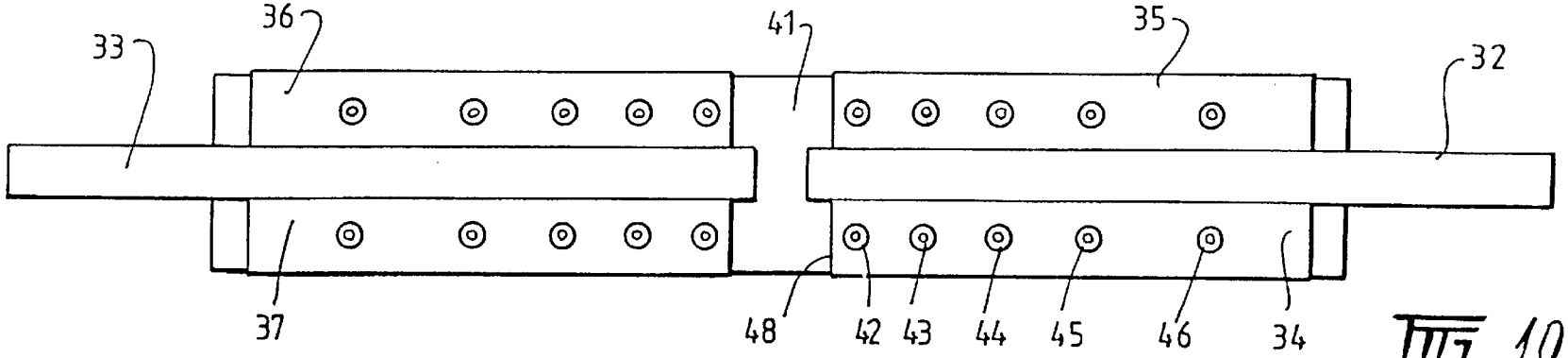
FIG. 10 is a bottom plan view of the cell of FIG. 9.

Referring now to FIGS. 9 and 10, the cathode block 30, made from anthracitic-graphitic carbon mixture or fully graphitic carbon, has a central channel 31 formed therein. The central channel 31 is not essential to the present invention and it was used in the test cell in order to enable cathode blocks produced in the cathode plant of the smelter to be used. Indeed, a more preferred embodiment of the present invention would omit the central channel 31 and utilise a cathode block having an essentially flat lower surface. A steel collector bar was cut in half and the pieces 32, 33 were placed in channel 31 with a gap of about 100 mm between the respective ends thereof (best shown in FIG. 10).

The collector plate of the test cell comprised four (4) mild steel strips 34, 35, 36, 37. Each strip 34, 35, 36, 37 had five (5) holes drilled therein to facilitate connection of the strips to the electrical contact plugs. The steel strips and collector bars were butted against each other and the strips were welded to the collector bars along the fill length of the strips. After welding, the collector bar/plate assemblies were turned over and fully welded on the inside of the plate/bar joint.

The welded plate/bar assemblies were then positioned over the cathode blocks and the precise location of the holes in the plates were transferred onto the cathode blocks. Holes were then drilled into the cathode blocks to enable electrical contact plugs to be formed in the cathode blocks. A metallic layer 38 was formed (e.g. by casting or welding) on the inner walls of the holes in the cathode blocks and copper inserts 39 were immersion welded to the metallic layer to create each electrical contact plug. As can be seen from FIG. 9, copper inserts 39 are sufficiently long to extend through the holes formed in the collector plates. The copper inserts 39 were then welded to the collector plates using a mild steel washer 40 positioned over the copper insert and welded to the insert and to the collector plate.

A layer of electrically insulating material 41 is placed between the collector bars 32, 33 to ensure that the collector bars are not connected to the cathode block 30.

FIG. 10 shows the positioning of the electrical contact plugs. Each collector plate is provided with five (5) electrical contact plugs. For example, collector plate 34 has electrical contact plugs 42, 43, 44, 45 and 46. For the sake of clarity, the electrical contact plugs for collector plates 35, 36, 37 have not been numbered. Contact plug 42 is positioned 50 mm from the inner end 48 of collector plate 34. Electrical contact plugs 43, 44, 45 and 46 are respectively positioned at distances of 182, 330, 510 and 750 mm from the inner end 48 of collector plate 34. These positions for the electrical contact plugs were selected to try to obtain uniform current distribution in the metal pad with a minimisation of horizontal currents in the metal pad. It will be appreciated that the spatial distribution of the electrical contact plugs shown in FIG. 10 is only illustrative and that other distributions may be used if other desired electrical fields and current distribution in the metal pad is required.

The test cell, as shown in FIGS. 9 and 10, was designed to operate with the parameters shown in Table 1. For comparison purposes, typical values for conventional cells operated at the Bell Bay Smelter are also included in Table 1.

TABLE 1

Design Operating Parameters of Test Cell and Comparison with Conventional Cell

| Parameter | Test Cell Design Value | Conventional Operating Value | Unit |
|---|---|---|---|
| Cell Current | 92 | 92 | kA |
| Metal Pad Height | 80 | 160 | mm |
| Cell Voltage | 4.20 | 4.6 | V |

TABLE 1-continued

| Design Operating Parameters of Test Cell and Comparison with Conventional Cell | | | |
|---|---|---|---|
| Parameter | Test Cell Design Value | Conventional Operating Value | Unit |
| Operating Range | 4.05–4.30 | 4.5–4.7 | V |
| Operating Window | 250 | 200 | mV |

Electrical modelling of the test cell was carried out to determine the current distribution in standard cells (using conventional embedded collector bars) and in the test cell. Table 2 is a compilation of the current distribution data obtained from 3-D electrical modelling, which shows that the test cell has better vertical current distribution than the standard cells. In Table 2, "Std" refers to a standard cell with 30% anthracitic, 70% graphitic cathodes and "Graphic Std" refers to a standard cell with 100% graphitic cathodes.

TABLE 2

| Vertical and Horizontal Current Distributions in Cells | | | | | |
|---|---|---|---|---|---|
| Cell | Metal Height | Vertical Current Distribution (amp/cm$_2$) | | Horizontal Current Distribution (amp/cm$_2$) | |
| Design | (mm) | Ave | S.D. | Ave | S.D. |
| Std | 180 | 0.756 | 0.245 | 0.320 | 0.166 |
| Graphitic Std | 180 | 0.744 | 0.296 | 0.804 | 0.188 |
| Test Cell | 180 | 0.849 | 0.076 | 0.286 | 0.103 |
| Std | 60 | 0.757 | 0.229 | 1.121 | 0.550 |
| Graphitic Std | 60 | 0.746 | 0.295 | 1.329 | 0.682 |
| Test Cell | 60 | 0.847 | 0.087 | 0.729 | 0.306 |

Operation of the test cell at the Bell Bay Smelter showed that a current efficiency of 94.5% was achieved, which compares to current efficiency of 92%, which is the power efficiency for cells at the Bell Bay Smelter with the same cathode and insulating material design using a standard collector bar technology. Initial power efficiency was 14.3 kW hr/kg of metal, which compares favourably to the cell power efficiency at the Bell Bay Smelter for similar cells using a standard collector bar technology of 15.0 kW hr/kg of metal. Initial lining drops for the test cell were measured at 160–210 mV, a saving of from 110–160 mV over initial lining drops in standard cells at the Bell Bay smelter. Operating the cell for a period of several weeks saw the lining drops increase but they still represented a saving of about 70 mV over standard cells.

Those skilled in the art will appreciate that the invention described herein is susceptible to variations and modifications other than those specifically disclosed. It is to be understood that the invention is considered to encompass all such variations and modifications that are all within its spirit and scope.

What is claimed is:

1. An electrolytic reduction cell for the production of a metal, comprising:

an outer steel shell;

a layer of insulating material adjacent the outer steel shell;

a carbonaceous layer overlaying the insulating material and protecting the insulating material from an electrolytic bath to be contained in the cell, the carbonaceous layer including at least one carbonaceous cathode block having an upper surface and a lower surface, a plurality of electrical contact plugs being mounted in electrical contact with the lower surface of the cathode block; and a collector plate in electrical contact with the electrical contact plugs, and which includes means for connection to a source of electric current;

wherein the electrical contact plugs are distributed over the lower surface of the cathode block such that in operation of the cell, a substantially isopotential surface is achieved at the top surface of the cathode block.

2. An electrolytic reduction cell as claimed in claim 1, wherein the electrical contact plugs are mounted in holes in the lower surface of the cathode block and immersion welded to carbon surfaces of the holes.

3. An electrolytic reduction cell as claimed in claim 2, wherein the electrical contact plugs are electrically connected to the collector plate by connector rods immersion welded into the plugs.

4. An electrolytic reduction cell as claimed in claim 3, wherein the connector rods are welded to the collector plate.

5. An electrolytic reduction cell as claimed in claim 4, wherein the connector rods extend from the contact plugs through holes in the collector plate to hooked ends which are welded to the collector plate adjacent the holes therein, whereby flexing of the hooked connector rods allows differential expansion movements between the cathode block and the collector plate.

6. An electrolytic reduction cell as claimed in claim 1, wherein the cathode block and the collector plate are of elongate shape and the electrical contact plugs are disposed in an elongate array extending along the cathode block.

7. An electrolytic reduction cell as claimed in claim 6, wherein said array is comprised of pairs of laterally spaced apart plugs arranged along the cathode at a longitudinal spacing which decreases progressively from opposite ends of the cathode.

* * * * *